US012631426B2

(12) United States Patent
Aral

(10) Patent No.: US 12,631,426 B2
(45) Date of Patent: May 19, 2026

(54) ADJUSTABLE REAR SIGHT USED FOR ADJUSTING HEIGHT AND DIRECTION DURING FIREARM AIMING

(71) Applicant: SAMSUN YURT SAVUNMA SANAYİ VE TİCARET ANONİM ŞİRKETİ, Tekkeköy (TR)

(72) Inventor: Cahit Utku Aral, Tekkeköy (TR)

(73) Assignee: SAMSUN YURT SAVUNMA SANAYI VE TICARET ANONIM SIRKETI, Samsun (TR)

( * ) Notice: Subject to any disclaimer, the term of this patent is extended or adjusted under 35 U.S.C. 154(b) by 0 days.

(21) Appl. No.: 19/100,689

(22) PCT Filed: Aug. 24, 2022

(86) PCT No.: PCT/TR2022/050906
§ 371 (c)(1),
(2) Date: Feb. 3, 2025

(87) PCT Pub. No.: WO2024/030086
PCT Pub. Date: Feb. 8, 2024

(65) Prior Publication Data

US 2026/0049792 A1 Feb. 19, 2026

(30) Foreign Application Priority Data

Aug. 4, 2022 (TR) ..... 2022/012396

(51) Int. Cl.
*F41G 1/26* (2006.01)
*F41G 1/18* (2006.01)
*F41G 1/24* (2006.01)

(52) U.S. Cl.
CPC ..... *F41G 1/26* (2013.01); *F41G 1/18* (2013.01); *F41G 1/24* (2013.01)

(58) Field of Classification Search
CPC ..... F41G 1/18; F41G 1/24; F41G 1/26; F41G 1/38–40; F41G 1/42; F41G 1/44; F41G 1/46
(Continued)

(56) References Cited

U.S. PATENT DOCUMENTS 547,423 A * 10/1895 Driggs ..... F41G 1/44 89/200
893,649 A * 7/1908 Phillips ..... F41G 1/26 42/137
(Continued)

FOREIGN PATENT DOCUMENTS

WO WO 2022-060543 A2 3/2022

OTHER PUBLICATIONS

International Search Report and Written Opinion mailed on May 12, 2023 in PCT International Application No. PCT/TR2022/050906.

*Primary Examiner* — Michael D David
(74) *Attorney, Agent, or Firm* — Jon E. Gordon; Haug Partners LLP

(57) ABSTRACT

The invention relates to the design of an adjustable rear sight assembly which is developed for improving the low hit rate that is caused by user or external errors in the daily use of firearms (4) and/or professional marksmanship contests; which provides a more stable shooting for the user by producing the fixed rear sight piece used in aiming the firearm (4) with adjustable height and direction. The rear sight lever (1), sliding rear sight (3) and closure part (2) form the rear sight assembly by being mounted to each other. The adjustable rear sight assembly is also formed on the firearm (4) and can be connected to the mounting surface (12).

9 Claims, 6 Drawing Sheets

(58) Field of Classification Search
USPC ..... 42/90–94, 111
See application file for complete search history.

(56) References Cited

U.S. PATENT DOCUMENTS 1,582,533 A * 4/1926 Packard, Jr. ..... F41A 19/07 42/16
1,737,974 A * 12/1929 Pedersen ..... F41A 9/70 42/75.01
1,940,416 A * 12/1933 Haubroe ..... F41G 1/16 89/204
2,585,933 A * 2/1952 Harvey ..... F41G 1/17 42/137
2,792,632 A * 5/1957 Pinkerton, Jr. ..... F41G 1/027 42/137
2,864,168 A * 12/1958 Sampson ..... F41G 1/26 42/137
2,881,524 A * 4/1959 Simeone ..... F41G 1/26 42/137
3,455,204 A * 7/1969 Stoner ..... F41A 19/59 89/129.01
3,512,449 A * 5/1970 Stoner ..... F41A 5/08 89/169
3,517,586 A * 6/1970 Stoner ..... F41A 19/33 89/198
3,566,744 A * 3/1971 Stoner ..... F41A 3/78 89/1.4
3,834,035 A * 9/1974 Merrill ..... F41G 1/08 42/133
4,012,844 A * 3/1977 Tellie ..... F41G 1/24 42/137
4,416,186 A * 11/1983 Sullivan ..... F41A 3/66 89/198
4,475,437 A * 10/1984 Sullivan ..... F41G 1/08 42/70.06
4,502,367 A * 3/1985 Sullivan ..... F41A 17/16 89/181
4,505,182 A * 3/1985 Sullivan ..... F41A 17/16 42/69.02
4,615,132 A * 10/1986 Smith ..... F41A 15/14 42/75.01
4,651,432 A * 3/1987 Bornancini ..... F41G 1/02 42/133
4,777,730 A * 10/1988 Huggins ..... F41G 1/38 42/148
5,063,677 A * 11/1991 Millett ..... F41G 1/28 42/137
5,245,776 A * 9/1993 Dornaus ..... F41A 21/48 42/144
5,467,552 A * 11/1995 Cupp ..... F41G 1/26 42/125
7,526,890 B1 * 5/2009 Keng ..... F41G 1/26 42/144
8,893,422 B2 * 11/2014 Wolf ..... F41G 1/00 42/111
10,955,219 B1 * 3/2021 Morris ..... F41G 1/545
2004/0226213 A1 * 11/2004 Woodbury ..... F41G 1/42 42/140
2006/0265930 A1 * 11/2006 Woodbury ..... F41G 1/10 42/137
2007/0199227 A1 * 8/2007 Ertl ..... F41G 1/26 42/137
2007/0234625 A1 * 10/2007 Kidd ..... F41G 1/28 89/41.17
2007/0240354 A1 * 10/2007 Warren ..... F41G 1/10 42/111
2008/0092424 A1 * 4/2008 Keng ..... F41G 1/18 42/137
2010/0005697 A1 * 1/2010 Fluhr ..... F41G 1/08 42/111
2011/0308133 A1 * 12/2011 Nemec ..... F41G 1/16 42/137
2013/0283660 A1 * 10/2013 Matthews ..... F41G 1/26 42/118
2014/0165446 A1 * 6/2014 Rozic ..... F41G 1/02 42/111
2014/0173965 A1 * 6/2014 Kennedy ..... F41G 1/033 42/135
2015/0128471 A1 5/2015 Troy
2015/0198415 A1 * 7/2015 Campean ..... F41G 1/30 42/137
2015/0241175 A1 * 8/2015 Wolf ..... F41G 11/005 42/124
2016/0223291 A1 * 8/2016 Wolf ..... F41G 1/24
2019/0017781 A1 * 1/2019 Noonan ..... F41G 1/18
2021/0003366 A1 1/2021 Weinland
2021/0270572 A1 * 9/2021 Dawson, Jr. ..... F41G 11/001
2023/0117500 A1 * 4/2023 Dawson, Jr. ..... F41G 11/001 42/111
2024/0401911 A1 * 12/2024 Mize ..... F41G 11/002
2025/0123079 A1 * 4/2025 Dawson, Jr. ..... F41G 11/001
2025/0334371 A1 * 10/2025 Aral ..... F41C 23/12

* cited by examiner

ADJUSTABLE REAR SIGHT USED FOR ADJUSTING HEIGHT AND DIRECTION DURING FIREARM AIMING

CROSS-REFERENCE TO RELATED APPLICATIONS

This application is a national stage entry under 35 U.S.C. § 371 of international application no. PCT/TR2022/050906, which was filed on Aug. 24, 2022, and published on Feb. 8, 2024, under publication no. WO 2024/030086, and which claims the benefit of priority under 35 U.S.C. § 119 of Türkiye patent application no. 2022/012396, which was filed on Aug. 4, 2022, all of which are incorporated herein by reference.

TECHNICAL FIELD

The invention relates to the design of an adjustable rear sight assembly which is developed for improving the low hit rate that is caused by user or external errors in the daily use of firearms and/or professional marksmanship contests; which provides a more stable shooting for the user by producing the fixed rear sight piece used in aiming the firearm with adjustable height and direction.

STATE OF THE ART

In firearms, during aiming; for the bullet to find the target, the shooter needs to align the eye, rear sight, front sight, and the target, respectively. For this principle, generally, the term 'eye, rear sight, front sight' concept is used. If the rear sight has not been adjusted to distance or there is no distance adjustment, the bullet will go under the target due to gravity. The bullet falling under the target shows that the shooting efficiency and hit rate of the user is low. To prevent these drawbacks, it is required to aim above the target as needed, depending on the distance in the firearms which do not have distance adjustment.

Nowadays, the fixed rear sight is commonly used. In the fixed rear sight system, the user shoots by aiming with this rear sight system used in a fixed condition to the firearm. In this usage, the user has to aim again after the shots as they burst. This causes the user to lose time and it is seen as an undesirable situation.

At the same time, the errors that are caused by the location of the front sight within the rear sight being distorted in a right-and-left or up-and-down directions result in lowering the user's shooting efficiency and target hit rate. Therefore, it is desired to fix the rear and front sights.

It is understood that the patent application numbered U.S. Pat. No. 4,837,937A describes a rear weapon sight unit comprising a head that extends a screw equipped with a notch for aiming at a target and that comprises a U-socket.

The said screw is understood to be adjustable to carry the notch to the right and left of the regular center to aim in negative wind conditions, and the head is vertically adjustable with respect to a support base to raise the notch to see a faraway target.

By using the rear sight structure of the patent numbered U.S. Pat. No. 4,837,937A, it is considered that various difficulties will be created for the adjustment of the rear sight by the user. Since the system is hard to use, it would not be possible to adjust fast and the adjustments will take a relatively long time.

Again, the rear sight structure described within the said patent application describes a structure which can only be suitable for connection to the weapon using structures belonging to the rear sight assembly, or to be produced in a unibody. Since the mounting elements created by this rear sight structure and their counterparts formed on the weapon are not designed in the way that different attachments would be able to be connected to the weapon, the user would not be able to dismantle the rear sight assembly and connect a different attachment easily.

When the rear sight adjustment is made by using the rear sight structure of the patent number U.S. Pat. No. 4,837,937A, the rear sight assembly does not give a warning to the user visually or by means of sound and vibration. This may prevent the user from fine-tuning as they adjust the Rear Sight.

Problems Aimed to be Solved by the Invention

Thanks to the designed novel invention, it is planned to prevent the undesirable situations caused by the rear sight structures of the present art. With the adjustable rear sight-front sight system, the aiming system adjusted for the user will minimize the time loss dependent on aiming in burst shootings. Thereby, it is planned for the user to reach a higher hit rate compared to the known state of the art and therefore to increase the shooting efficiency.

The adjustable rear sight assembly of the invention can be easily mounted to the weapon and used. The section where the rear sight assembly connects to the weapon is provided over a mounting surface at the back of the weapon. The mounting surface forms a placement surface suitable for the connection of the rear sight assembly and it can provide a placement surface suitable for other attachments to connect to the weapon.

Thereby, the user will be able to dismantle the rear sight assembly effortlessly and connect the attachments such as red dot, telescope, etc. to the weapon without effort as well.

With the rear sight assembly of the invention, the user will be able to adjust the rear sight easily in right-and-left or up-and-down directions. This adjustment provides the user ease since it operates by means of easy-to-use connections and adjustment elements.

The adjustable rear sight structure of the invention may be moved up and down based on the upper surface of the weapon by means of a connection and adjustment element. When the user rotates the connection and adjustment element to a particular direction, they can move the adjustable rear sight up from the weapon and in the reverse movement of the connection and adjustment element, it can carry the adjustable rear sight down in the direction of the weapon.

Within the rear sight assembly of the invention, the connection and adjustment element is operated in connection with a ball. In the section where the said ball contacts the connection and adjustment element, it is formed with a protruding and recessed structure. Thereby, with the movement of the connection and adjustment element, the user may be warned by means of sound and vibration as the rear sight moves.

DESCRIPTION OF THE REFERENCES IN THE FIGURES

Figure 1:
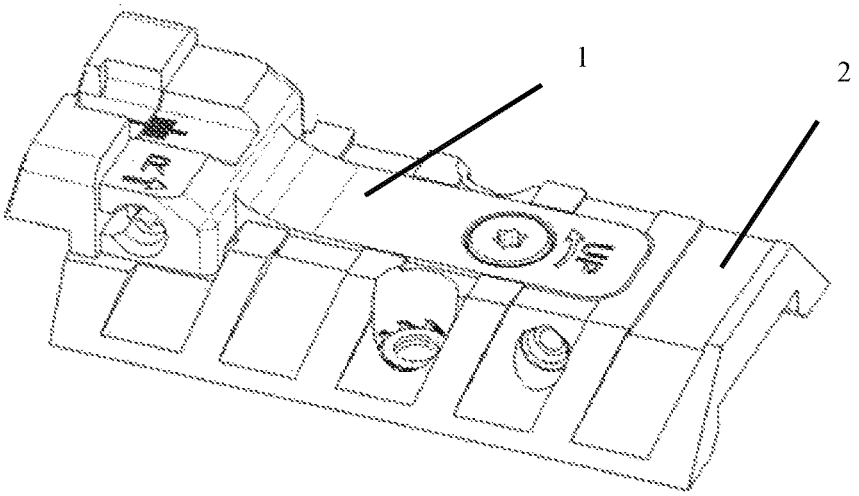
FIG. 1. Isometric Right View of the Adjustable Rear Sight Assembly

1. Adjustable rear sight
- 1.1. Height adjustment spring
- 1.2. Ball
- 1.3. Connection element
- 1.4. Ball socket

2. Closure part
- 2.1. Rear sight lever socket
- 2.2. Adaptation gap

3. Sliding rear sight
- 3.1. Mounting spring
- 3.2 Adjustment element
- 3.3. Sliding rear sight socket
- 3.4. Mounting protrusion

4. Firearm

5. Spring socket

6. Connection and adjustment element
- 6.1. Protrusion
- 6.2. Recess

7. Connection member socket

8. Pin

9. Pin socket

10. Mounting member

11. Sleeve

12. Mounting surface

DESCRIPTION OF THE INVENTION

The invention relates to the design of an adjustable rear sight assembly which is developed for improving the low hit rate that is caused by user or external errors in the daily use of firearms (4) and/or professional marksmanship contests; which provides a more stable shooting for the user by producing the fixed rear sight piece used in aiming the firearm (4) with adjustable height and direction.

The rear sight lever (1), sliding rear sight (3) and closure part (2) pieces form the rear sight assembly by being mounted to each other. The adjustable rear sight assembly is again formed on the firearm (4) and it may be connected to the mounting surface (12).

According to the preferred embodiment of the invention, the adjustable rear sight assembly comprises;

at least one spring socket (5) formed on the surface mounted to the weapon (4) for positioning at least one height adjustment spring (1.1) therein; connection member socket (7) formed on the surface not mounted to the weapon for receiving the connection and adjustment element (6) which can move the rear sight lever up and down with respect to the firearm (4) surface with its movement; pin sockets (9) aiming to receive at least one pin (8) together with the pin sockets (9) formed on the closure part (3) and the rear sight lever (1) equipped with at least sliding rear sight socket (3.3) formed at the opposite end of the end in which the said pin sockets (9) are formed, sliding rear sight (1) equipped with a mounting protrusion (3.4) aiming to exit from its body and connect to the sliding rear sight socket (3.3), at least one mounting spring (3.1) aiming to be placed within the sliding rear sight socket (3.3) by connecting to the said mounting protrusion (3.4) and the adjustment member (3.2) which can change the direction of the sliding rear sight (3) vertically to the shooting direction of the weapon relative to the rear sight lever (1) by stretching and releasing the said mounting spring/springs (3.1) within the sliding rear sight socket (3.3), the closure part (2), on the upper surface of which the rear sight lever surface (2.1) is formed for the placement of the rear sight lever (1) and pin sockets (9) are formed for the placement of the said pins (8), and on the lower surface of which the adaptation gap (2.2) aiming to connect to the mounting surface (12) configured on the weapon is formed.

Thanks to the above-described embodiment, the rear sight lever (1) can move up and down by being separated from the closure part (2) in the connection axis formed by the pins (8). This embodiment provides the movement required for raising or lowering the rear sight in the adjustable rear sight assembly.

Again, changing the direction of the sliding rear sight (3) vertically to the shooting direction of the weapon relative to the rear sight lever (1) allows for the adjustment of the rear sight with its right and left movement.

Figure 2:
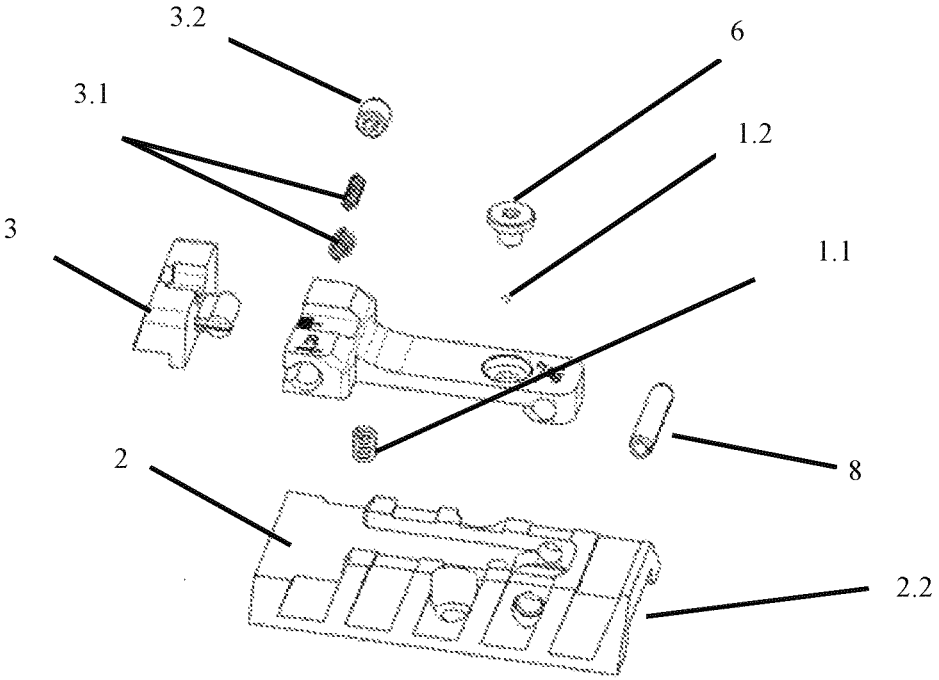
FIG. 2. Exploded View of the Adjustable Rear Sight Assembly
Figure 3:
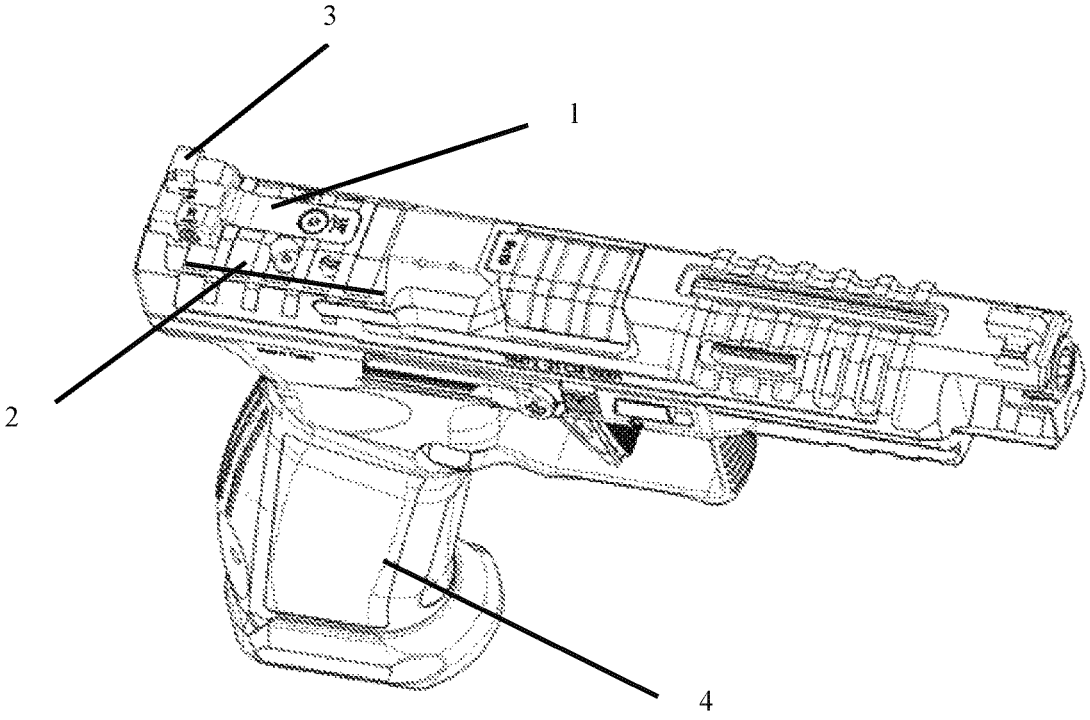
FIG. 3. View of the Rear Sight Assembly Mounted to the Gun
Figure 4:
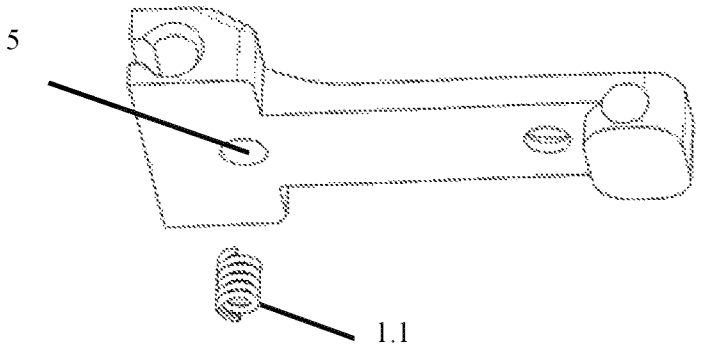
FIG. 4. Bottom View of the Adjustable Rear Sight
Figure 5:
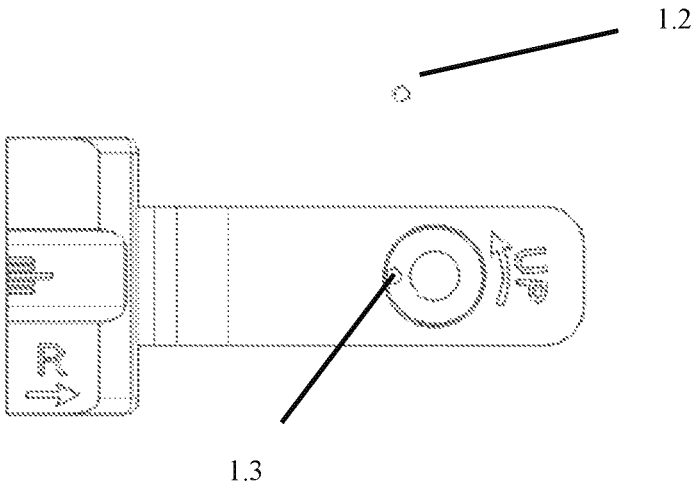
FIG. 5. Top View of the Adjustable Rear Sight

According to FIG. 2, which shows the preferred embodiment of the invention, the connection member socket (7) formed on the rear sight lever (1) is equipped with at least one ball socket (1.3). This ball socket (1.3) comprises at least one ball (1.2) positioned in the way to be associated with the connection and adjustment element (6) inside the same.

Figure 10:
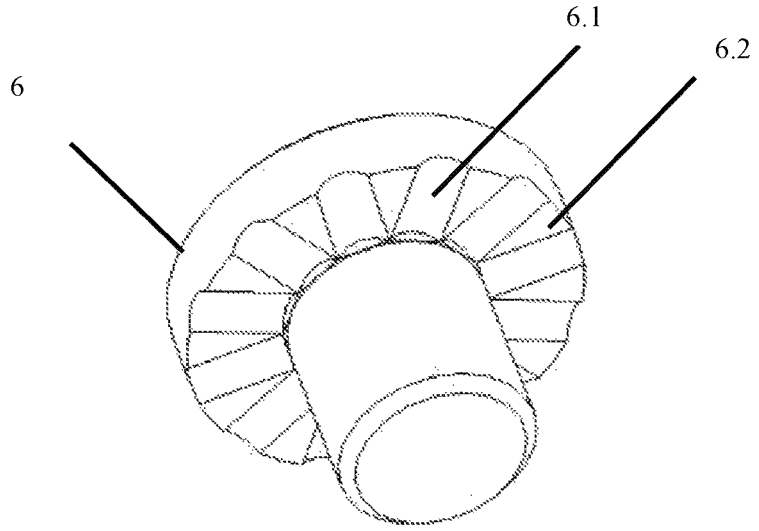

According to FIG. 10, which shows one of the preferred embodiments of the invention, the connection and adjustment element (6) is in screw form. The surface of the screw cap facing the connection member socket (7) is in direct contact with the ball (1.2).

According to FIG. 10, the said surface of the screw cap comprises at least one protrusion (6.1) and recess (6.2). In the cases where the user rotates the connection and adjustment element (6) (adjusts the rear sight lever (1)) since the surface and the ball (1.2) are in contact, since the ball (1.2) moves between the protrusion (6.1) and recess (6.2), it will be able to warn the user by forming sound and vibration.

Again, according to FIG. 10 which shows the preferred embodiment of the invention, all of the said surfaces of the screw cap are equipped with protrusions (6.1) and recesses (6.2) that are formed successively. This embodiment will enable the protrusions (6.1) and recesses (6.2) to interact with the ball (1.2) along the entire movement of the connection and adjustment element (6) and thereby, for the user to be informed.

Figure 9:
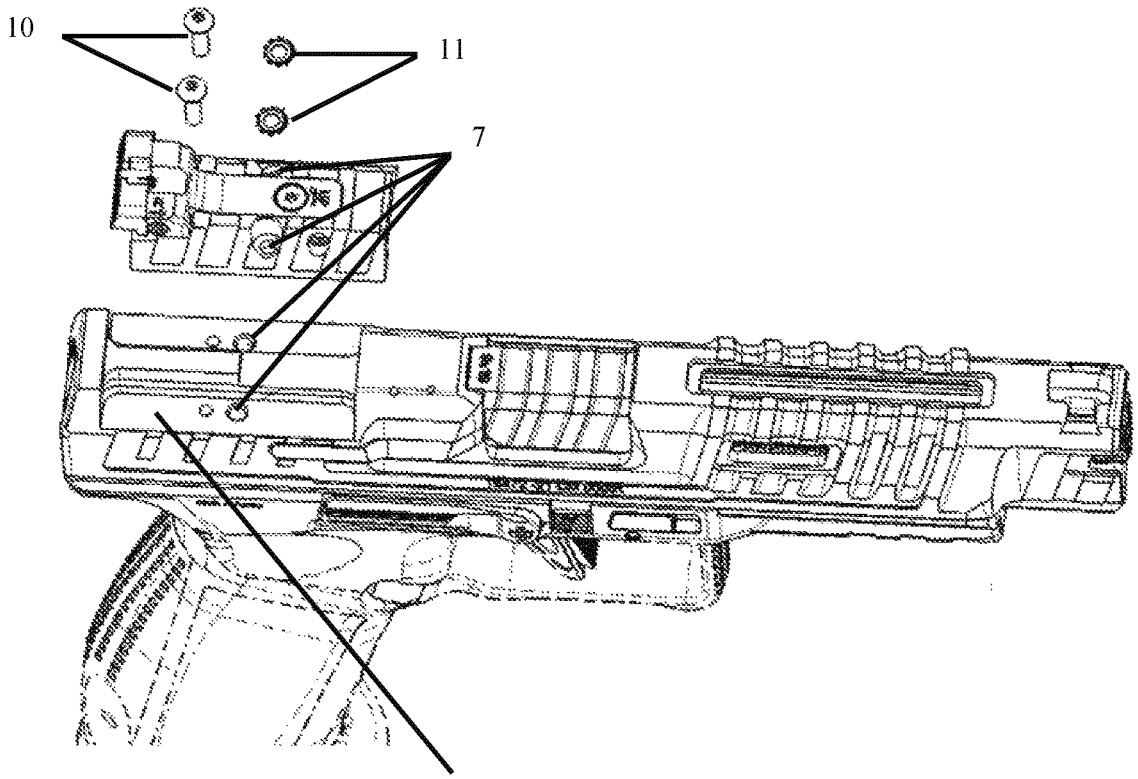

According to FIG. 9, the section where the rear sight assembly will be mounted on the firearm (4) is designed in a way that a protrusion will be present at the middle part of the mounting surface (12) and a gap at both sides of this protrusion.

Within this embodiment, the adaptation gap (2.2) aims to be seated on the protrusion in the middle part and the wall of this closure part (2) to be placed on the two gaps.

According to FIG. 9, the mounting surface (12) is equipped with connection member sockets (7). These sockets (7) overlap with the connection member sockets (7) formed on the closure part (2) and aim to lock by means of a mounting member (10).

According to the preferred embodiment, the mounting member (10) is in screw form and can be fixed by a sleeve (11).

Figure 6:
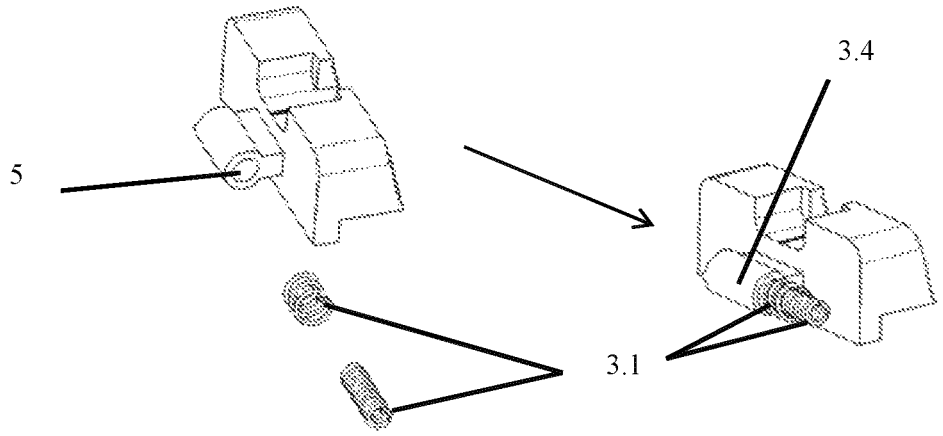
FIG. 6. Demounted and Mounted View of the Sliding Rear Sight
Figure 7:
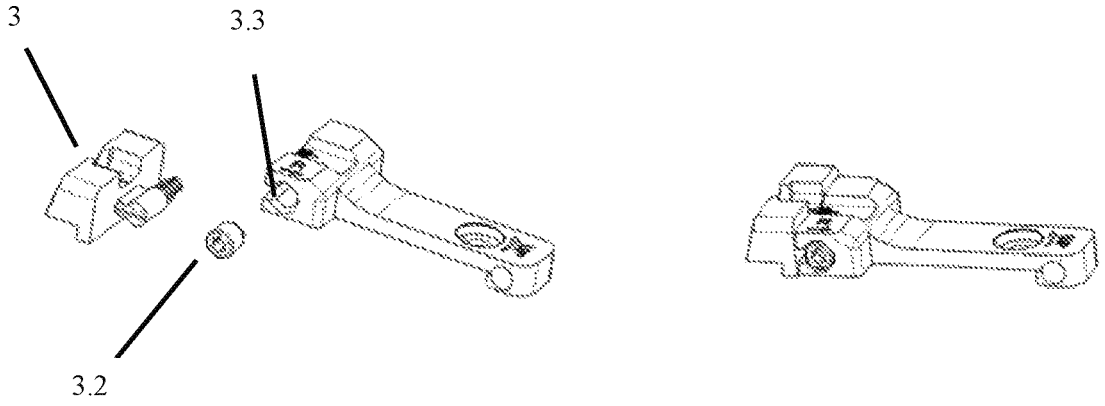
FIG. 7. View of the Sliding Rear Sight Demounted and Mounted to the Adjustable Rear Sight FIG. 8. View of the Closure Part with the Adjustable Rear Sight FIG. 9. View of the Adjustable Rear Sight with the Firearm FIG. 10. Detailed View of the Connection and Adjustment Element
Figure 8:
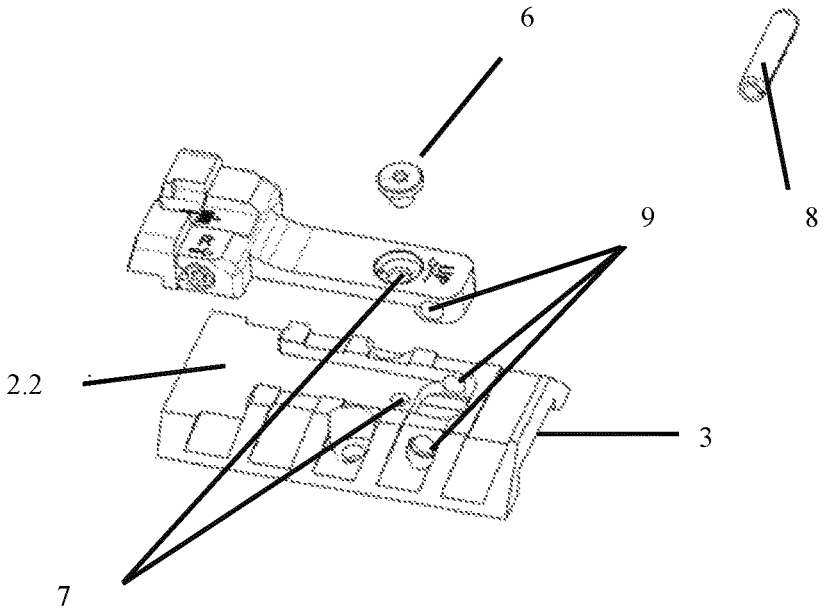

According to FIG. 6, which shows the preferred embodiment of the invention, the mounting protrusion (3.4) formed on the sliding rear sight (1) is associated with 2 mounting springs (3.1). In this embodiment, one of the springs has a long structure while the other is short. Thereby, the 2 springs (3.1) may be operated by being placed inside each other.

To form the adjustable rear sight assembly of the invention, the following steps may be followed.

First, the height adjustment spring (1.1) whose spring socket (5) at the bottom part of the rear sight lever (1) has been greased is tightened and fixed. Then, the greased ball (1.2) is placed in the ball socket (1.4) part on the top part.

For the mounting of the sliding rear sight (3); the long mounting spring (3.1) is passed within the short mounting spring (3.1) and placed within the spring socket (5) at the front of the sliding rear sight (3). The sliding rear sight (3) whose springs (3.1) are placed is passed within the sliding rear sight socket (3.3) at the back part of the rear sight lever (1) and fixed with the adjustment member (3.2).

The resulting partial assembly is placed within the rear sight lever socket (2.1) at the top part of the closure part (2) in the way that the pin sockets (7) and connection member sockets (7) will correspond. Then, the pin (8) is passed from the corresponding pin sockets (9) and fixing is provided.

The adjustable rear sight assembly formed is placed in the connection member sockets (7) sleeve (11) on the firearm (4). The mounting members (10) are seated on the sleeves (4) and the mounting is complete.

After the adjustable rear sight assembly whose mounting is finished is mounted to the firearm (4), the right-left direction adjustment of the adjustable rear sight is performed with the rear sight lever (1) being fixed to the adjustment member (3.2) and sliding rear sight socket (3.3) at the back. At the same time, the ball (1.2) placed at the top of the rear sight lever (1) provides for the up and down movement of the adjustable rear sight with the connection member (6) that provides for the fixing to the closure part (2).

Thereby, the direction and height adjustment feature during the aiming provides for the user that the time loss is minimized during aiming and the adjustable rear sight assembly that provides the maximum shooting ratio can be formed.

What is claimed is:

1. An adjustable rear sight assembly connected to the firearm in a detachable manner; which is formed by mounting the rear sight lever, sliding rear sight and closure part to each other; is developed for improving the low hit rate that is caused by user or external errors in the daily use of firearms and/or professional marksmanship contests; provides a more stable shooting for the user by producing the fixed rear sight piece used in aiming the firearm with adjustable height and direction, the adjustable rear sight assembly comprising:

at least one spring socket formed on the surface mounted to the weapon for positioning at least one height adjustment spring therein; connection member socket formed on the surface not mounted to the weapon for receiving the connection and adjustment element which can move the rear sight lever up and down with respect to the firearm surface with its movement; pin sockets aiming to receive at least one pin within, together with the pin sockets formed on the closure part and the rear sight lever equipped with at least sliding rear sight socket formed at the opposite end of the end in which the said pin sockets are formed;

sliding rear sight equipped with a mounting protrusion aiming to exit from its body and connect to the sliding rear sight socket, at least one mounting spring aiming to be placed within the sliding rear sight socket by connecting to the said mounting protrusion and the adjustment member which can change the direction of the sliding rear sight vertically to the shooting direction of the weapon relative to the rear sight lever by stretching and releasing the said mounting spring/springs within the sliding rear sight socket; and the closure part, on the upper surface of which the rear sight lever surface is formed for the placement of the rear sight lever and pin sockets are formed for the placement of the said pins, and on the lower surface of which the adaptation gap aiming to connect to the mounting surface configured on the weapon is formed.

2. An adjustable rear sight assembly according to claim 1, wherein:

the connection member socket formed on the rear sight lever is equipped with at least one ball socket; and the said ball socket comprises at least one ball positioned in the way to be associated with the connection and adjustment element.

3. An adjustable rear sight assembly according to claim 2, wherein; the adjustment element is in screw form and the surface of the screw cap facing the connection member socket and the ball are in direct contact.

4. An adjustable rear sight assembly according to claim 3, wherein sound and vibration can be formed with the surface and the ball being in contact in the cases where the user rotates the connection and adjustment element and since the protrusion/protrusions and recess/recesses are formed on the surface of the screw cap facing to the connection member socket.

5. An adjustable rear sight assembly according to claim 4, wherein the whole surface of the screw cap facing the connection member socket is equipped with protrusions and recesses that are formed successively.

6. An adjustable rear sight assembly according to claim 1, further comprising:

the firearm equipped with the mounting surface which is designed as a protrusion at the middle part and gaps at two sides of this protrusion; and the adaptation gap whose mounting surface aims to be seated on the protrusion in the middle part, and the closure part whose walls aim to be seated on the two gaps formed at the sides of the protrusion.

7. An adjustable rear sight assembly according to claim 1, further comprising the mounting surface equipped with connection member sockets aiming to be locked by means of a mounting member by overlapping with the connection member sockets formed on the closure part.

8. An adjustable rear sight assembly according to claim 7, further comprising the mounting member which has a screw form and can be fixed by a sleeve.

9. An adjustable rear sight assembly according to claim 1, wherein the sliding rear sight associated with 2 mounting springs, one of which is long and the other short, aiming to be placed inside each other, with the mounting protrusion formed thereon.

* * * * *